US005993224A

United States Patent [19]

Quillet et al.

[11] Patent Number: 5,993,224

[45] Date of Patent: Nov. 30, 1999

[54] INPUT/OUTPUT CONNECTOR FOR PORTABLE COMMUNICATION DEVICE AND PROCESS FOR MOUNTING THE SAID CONNECTOR

[75] Inventors: Thierry Quillet, La Milesse; Jean-Louis Perrono, Saint Martin des Monts; Christophe Dehan, Le Mans, all of France

[73] Assignee: Framatome Connectors International, Courbevoie, France

[21] Appl. No.: 09/058,382

[22] Filed: Apr. 9, 1998

[30] Foreign Application Priority Data

Apr. 11, 1997 [FR] France ..... 97 04584

[51] Int. Cl.[6] ..... H01R 9/09

[52] U.S. Cl. ..... 439/79; 439/570

[58] Field of Search ..... 439/79, 80, 59, 439/570, 571

[56] References Cited

U.S. PATENT DOCUMENTS 5,310,360 5/1994 Peterson ..... 439/571

5,575,663 11/1996 Broschard, III et al. ..... 439/79

FOREIGN PATENT DOCUMENTS 0 633 631 A1 1/1995 European Pat. Off. .

0 739 063A2 10/1996 European Pat. Off. .

WO 96/07221 3/1996 WIPO .

*Primary Examiner*—Neil Abrams

*Assistant Examiner*—Javaid Nasri

*Attorney, Agent, or Firm*—Perman & Green, LLP

[57] ABSTRACT

An electrical connector for a portable communication device. The connector is intended to be surface mounted to a printed circuit board of the portable communication device. The connector has a housing and contacts to be soldered to the printed circuit board. The housing has snap-fit lugs and positioning dogs to locate the housing for pressing the contacts on the printed circuit board with coflatness of the contacts before soldering of the contacts to the printed circuit board.

7 Claims, 4 Drawing Sheets

INPUT/OUTPUT CONNECTOR FOR PORTABLE COMMUNICATION DEVICE AND PROCESS FOR MOUNTING THE SAID CONNECTOR

BACKGROUND OF THE INVENTION

The present invention relates to an input/output connector intended to be surface-mounted on a printed circuit board PCB comprising, among other things, an insulating housing on whose lateral parts are fixed two positioning dogs to be soldered to the PCB, contacts to be soldered to the PCB. It also relates to the process for mounting the said connector.

In a general and known manner, the input/output connector of a portable communication device, for example a mobile telephone, which is of very small dimensions, is surface-mounted on a printed circuit board PCB. For the sake of conciseness and simplification the printed circuit board will hereafter be referred to as PCB ("Printed Circuit Board"), the term commonly used by those skilled in the art. This connector thus makes it possible to connect and disconnect an exterior electronic device, equipped with a complementary connector, to the portable communication device so as to permit dialogue between the two devices, or the testing of the functions or components installed on the PCB. Given the very small size of the connector used for this type of application and the vital need for highly accurate positioning during the mounting thereof so that the bearing plane of the connector coincides or at least almost coincides with the plane of the PCB, specific means for positioning and fixing the connector as well as the contacts must be provided. Thus, when implementing the product, the surface-mounting of the component, and also throughout the lifetime of the portable device, sometimes under severe handling conditions, all the contacts of the complementary connectors should be able to engage with one another and ensure that the contact pressure is adequate for good electrical transmission. Thus, it has been observed that for this function to be effective, it is necessary for the bearing plane of the connector to coincide or at least almost coincide with the plane of the PCB. In fact, this coplanarity provides for an efficient answer to a requirement for so-called coflatness, necessary for the implementation of the surface-mounting process, which requirement implies that any contact must be located within a maximum tolerance interval, which is desired to be small (for example of the order of 0.1 mm), in relation to the plane of bearing of the connector on the PCB, which bearing plane defines the plane of reference for the said coflatness.

International application WO 96/07221 describes such a connector which uses metal soldering fixings intended for holding it and setting it in position on the PCB. However, the use of such fixings has a considerable drawback since it does not allow the abovementioned necessary accuracy and hence the coflatness requirement to be met sufficiently rigorously. This is because the fixings described rest on the PCB over the whole of the surface of their base whilst, moreover, the connector rests at the rear on the said PCB either on a mounting surface or on a set of contacts. Thus, three surfaces which are independent and consequently whose probability of being coplanar is extremely small, the two surfaces of the bases of the fixings and the surface via which the rear of the connector rests on the PCB, are in this case involved in determining the plane of bearing of the connector on the PCB. Moreover, the dimensional constraints of the product do not allow sufficiently accurate guiding of the contacts. All of the above implies that this bearing plane evidently cannot be determined in an accurate and reproducible manner and yet, as was stated earlier, this bearing plane defines the plane of reference for the coflatness of the contacts and thus a considerable scatter is created as regards the coflatness.

SUMMARY OF THE INVENTION

In this context, the object of the present invention is efficiently to overcome this considerable drawback exhibited by the prior art and proposes an input/output connector whose design makes it possible to guarantee that the contacts, during mounting on the PCB, will all lie accurately and reproducibly at least in a predetermined tolerance interval, the maximum tolerance interval, and that the coflatness requirement can thus be satisfied rigorously.

To do this, the input/output connector mentioned in the preamble is noteworthy in that it comprises an elastic means for holding of the snap-fit type to the PCB intended, when the said connector is placed on the PCB for surface-mounting, to hold the contacts pressing on the said PCB, the surface-soldering thus being carried out while each of the contacts is in a position such that it is contained in a plane of reference for the coflatness of the said contacts.

In a subsidiary manner, the input/output connector comprises an elastic means for holding of the snap-fit type to the PCB intended, when the said connector is placed on the PCB for surface-mounting, to hold the contacts pressing on the said PCB, the surface-soldering thus being carried out while each of the contacts is in a position such that it lies in a predetermined tolerance interval with respect to a plane of reference for the coflatness of the said contacts.

In a likewise noteworthy manner, according to the present invention, there is provided a process for mounting the input/output connector, in the course of which, when the said connector is presented so as to be jammed into a housing of the PCB provided for this purpose, the bearing load exerted on the connector, in a placement phase during surface-mounting, is used to bring about the automatic snap-fitting of the connector to the PCB, the assembly thus pressed together being surface-mounted on the PCB in the exact desired plane.

Thus, the invention consists advantageously in designing a connector provided with an elastic means of holding which, when placing the connector on the PCB, will make it possible to apply pressure and, once the snap-fitting has been carried out automatically, to keep the contacts constrained on the PCB in a position such that each of the said contacts, once immobilized, is contained in a plane of reference for the coflatness of the contacts, or at worst, subsidiarily, lies in the predetermined maximum tolerance interval with respect to the said plane of reference. Thus, in a general manner, in the placement phase (termed "pick and place" by those skilled in the art) carried out by a machine for the surface-mounting of a component (here a connector), a bearing load of the order of 100 to 300 grams is exerted on the components. The technique utilized therefore consists in using this load to snap-fit the connector to the PCB automatically. The term "of the snap-fit type" should here be given its widest expression permitting the choice of means such as: fastening pins, snap-fit lug, quick-setting cement spot, etc. This technique is accurate, efficient and reproducible and the coflatness requirement is thus guaranteed to be complied with in full. Moreover, by virtue of the snap-fit means which makes it possible to hold the contacts constrained in the desired position, an operation of cementing the said contacts is completely obviated, this constituting another considerable advantage.

BRIEF DESCRIPTION OF THE DRAWINGS

The following description, in conjunction with the appended drawings, the whole given by way of non-limiting example, will elucidate the manner in which the invention may be practised.

DETAILED DESCRIPTION OF THE PREFERRED EMBODIMENTS

Figure 1:
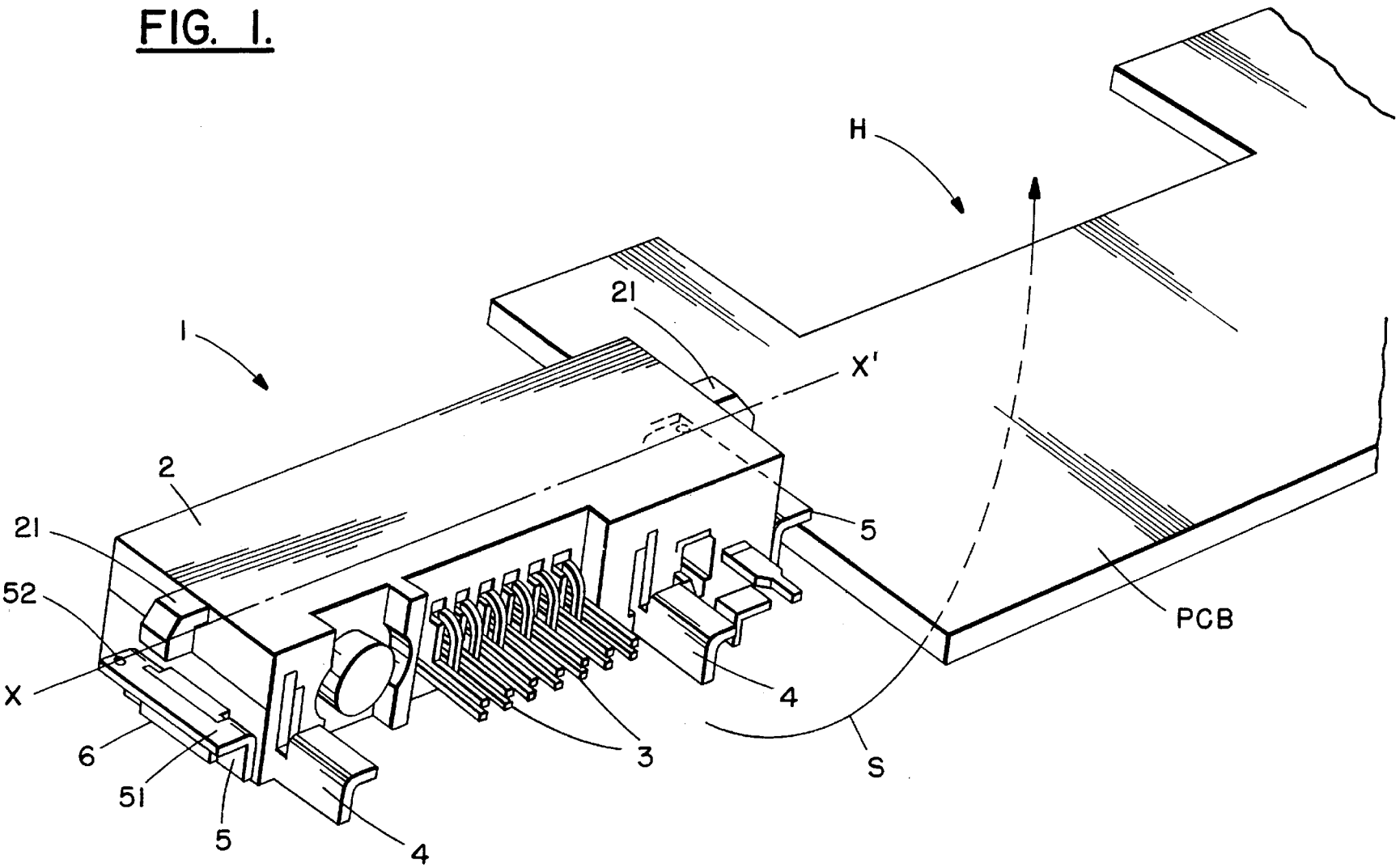
FIG. 1 represents in perspective and in a first embodiment, the connector according to the invention before it is mounted on the PCB.
Figure 2:
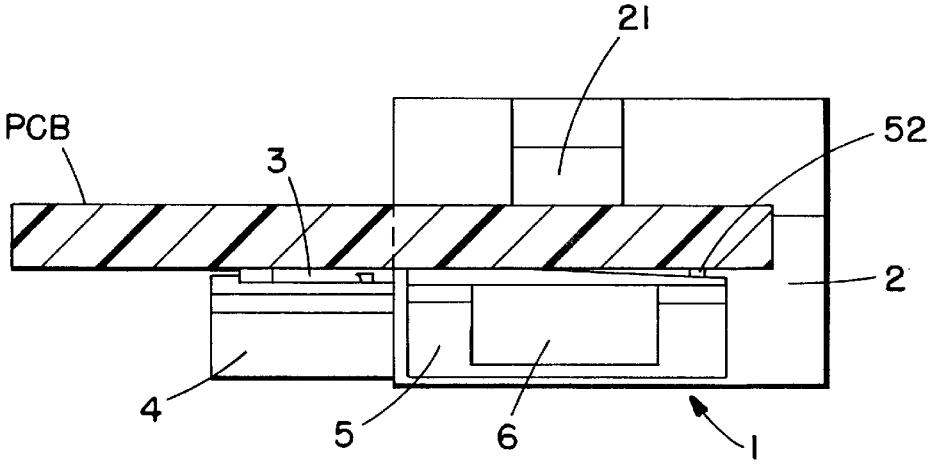
FIG. 2 shows a side view of the connector of FIG. 1 after it is mounted on the PCB.

FIGS. 1 and 2 will be utilized simultaneously for a proper understanding of the characteristics of the connector in accordance with the invention in its first embodiment. Represented in perspective in FIG. 1 is a connector 1 intended to be surface-mounted, that is to say to be soldered according to the "surface-mounted components" (termed SMC by those skilled in the art) technology, on a printed circuit board PCB which comprises a housing H to which the connector 1 is presented (the arrow labelled S in FIG. 1 specifies the direction of placement) and then jammed fast. The connector 1 consists chiefly of an insulating body 2, it comprises a set of contacts 3, a pair of interlocks 4 intended to be soldered to the PCB as well as a pair of positioning dogs 5 likewise intended to be soldered to the PCB to hold the connector in position on the said PCB. Preferably, the positioning dogs 5 are mounted in a removable manner on the body 2 which, in order to receive them, has on its two side walls two lugs 6 in the shape of an inverted L and under which each positioning dog 5 is slid and immobilized. Each positioning dog 5 can comprise, on its flat part 51 intended to come into contact with the PCB and located towards its end situated furthest outboard of the PCB, a projection 52 or boss of small height designed to form a point contact with that part of the PCB intended to receive it. The two points of contact of the two projections 52 therefore mathematically determine a straight line support for an axis of rotation XX' of the connector allowing it, while it is being mounted, to swing in such a way that the contacts 3 are brought close in turn to corresponding contact pads of the PCB (which are not shown in the drawing). This projection 52 and its characteristics are disclosed in detail in a French Patent Application filed on the same date by the same applicant, this Patent Application being incorporated herein by way of reference. In accordance with the invention the input/output connector is noteworthy in that it comprises an elastic means for snap-fit holding the housing to the PCB which is intended, when the said connector is placed on the PCB for surface-mounting, to hold the contacts pressing on the said PCB, the surface-soldering thus being carried out while each of the contacts is in a position such that it is contained in a plane of reference for the coflatness of the signal contacts, or lies in a predetermined tolerance interval with respect to the said plane of reference. In the first embodiment of the connector according to FIGS. 1 and 2, the elastic means for holding of the snap-fit type consists of snap-fit lugs 21 (deliberately represented thicker than necessary in the drawing so as better to elucidate the possible shape) situated on the lateral parts of the insulating housing 2 opposite the positioning dogs 5 in such a way that the PCB is, once the snap-fitting has been effected at the time that the bearing load is exerted on the connector 1 for the surface-mounting, held clamped between the said snap-fit lugs 21 and the said positioning dogs 5 while the contacts 3 then in contact are constrained on the corresponding contact pads of the PCB.

Figure 4:
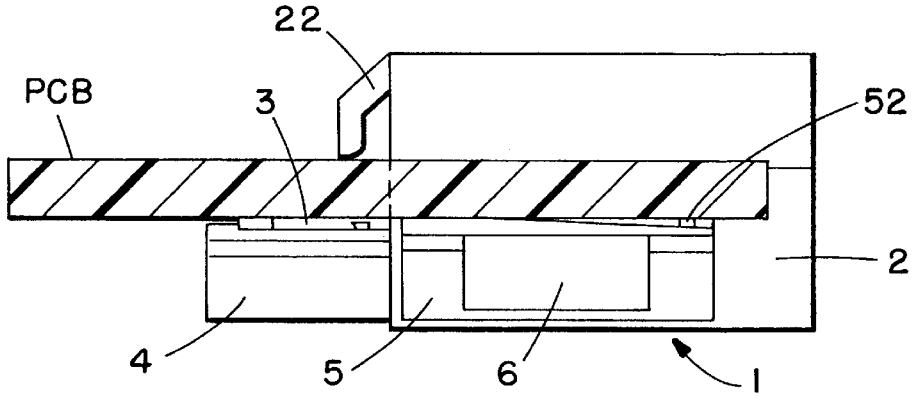
FIG. 4 shows a side view of the connector of FIG. 3 after it is mounted on the PCB.
Figure 3:
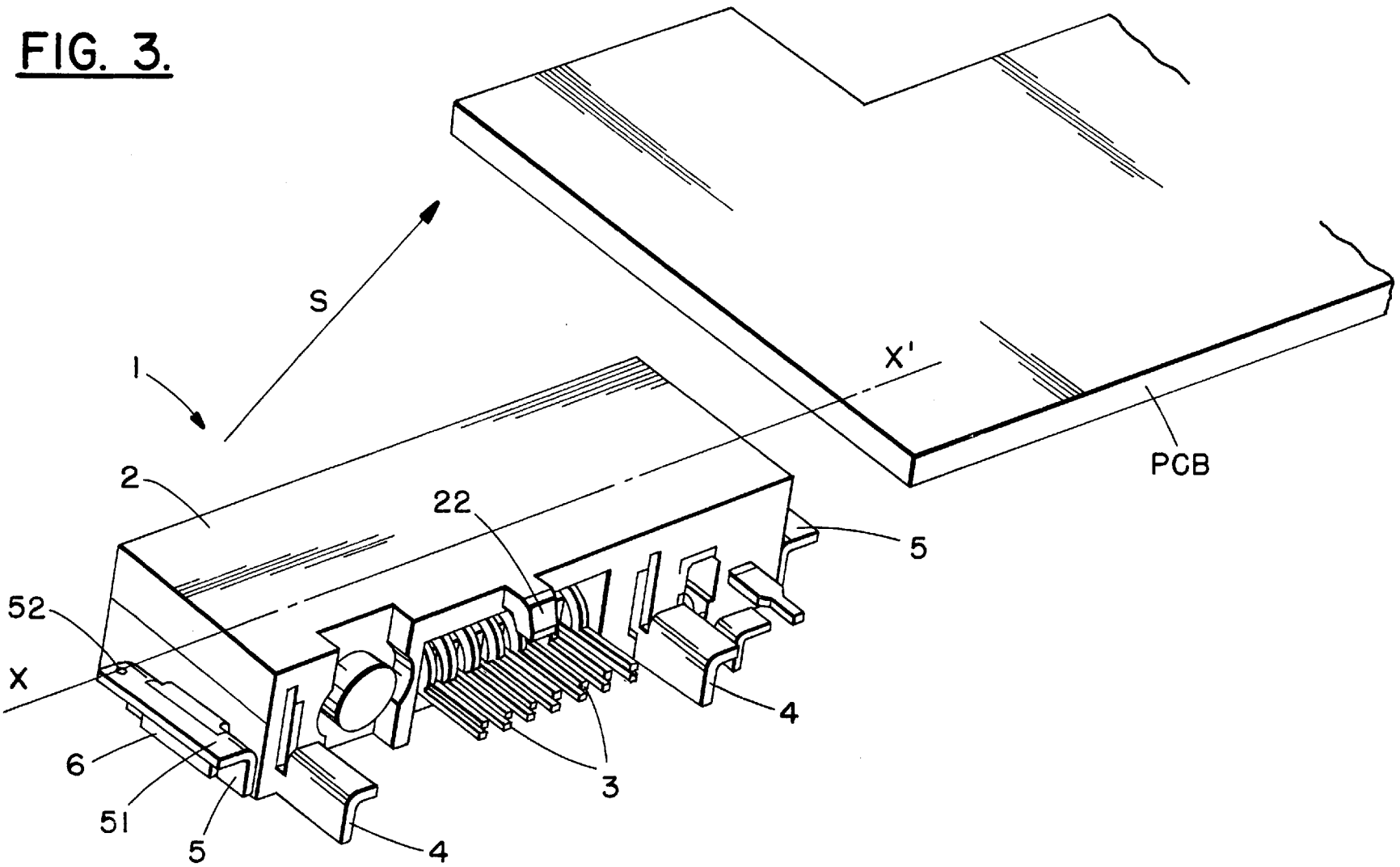
FIG. 3 represents in perspective and in a second embodiment, the connector according to the invention before it is mounted on the PCB.

In the second embodiment depicted in FIGS. 3 and 4, the same labels apply to elements identical to those of FIGS. 1 and 2. In this second embodiment, the elastic means for holding of the snap-fit type consists of at least one snap-fit lug 22 (deliberately represented thicker than necessary in the drawing so as better to elucidate the possible shape) situated on the rear part of the insulating housing 2 opposite the contacts 3 in such a way that the PCB is, once the snap-fitting has been effected at the time that the bearing load is exerted on the connector 1 for surface-mounting, held clamped between the said snap-fit lug 22 and the contacts 3 while constrained on the corresponding contact pads of the PCB.

Figure 6:
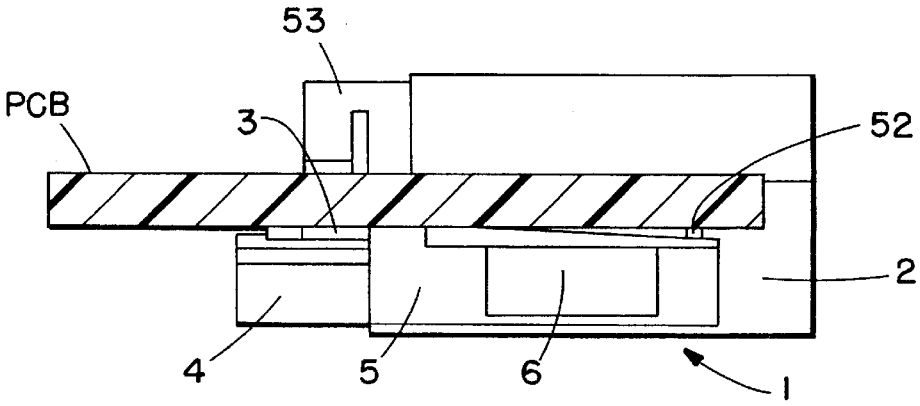
FIG. 6 shows a side view of the connector of FIG. 5 after it is mounted on the PCB.
Figure 5:
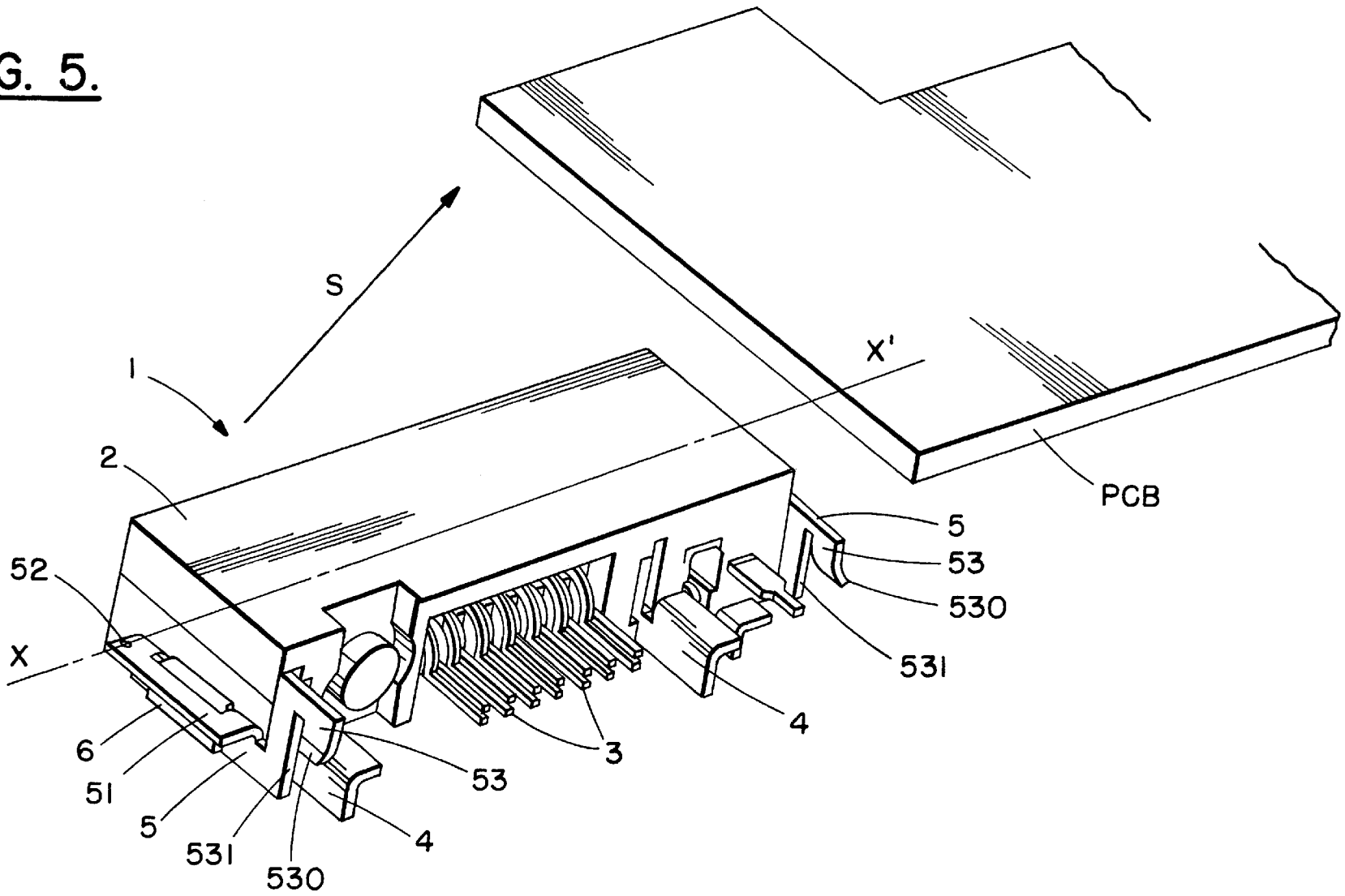
FIG. 5 represents in perspective and in a third embodiment, the connector according to the invention before it is mounted on the PCB.

In the third embodiment depicted in FIGS. 5 and 6, the same labels apply to elements identical to those of FIGS. 1 and 2. In this third embodiment, the elastic means for holding of the snap-fit type consists of snap-fit lugs 53 situated directly in line with and to the rear of the positioning dogs 5 so that the PCB is held clamped between the said snap-fit lugs 53 and the contacts 3 while constrained on the corresponding contact pads of the PCB. The PCB is furthermore trapped between the snap-fit lugs 53 and the interlocks 4. Moreover, in a preferred manner, the extreme parts 530 of the snap-fit lugs 53 intended to come into contact with the PCB possess a cutout 531 and are inclined with respect to the plane orthogonal to the plane of the PCB in such a way as to amplify the elastic effect as may be seen in FIGS. 5 and 6. Indeed, the inclined geometry of the section through these snap-fit lugs 53 makes it possible to maintain pressure on the contacts 3 by take-up of play.

This technique implemented in a non-limiting manner according to the various embodiments, whilst offering excellent reproducibility, affords a simple and efficient solution to the problem posed by the coflatness requirement. Furthermore, as stated earlier, such a technique using snap-fit means, owing simply to the fact that it makes it possible to hold the contacts constrained in the desired position by altering their elasticity, completely obviates any operation of cementing the said contacts, an operation ordinarily employed for the connectors of the prior art.

We claim:

1. Input/output connector for portable communication device intended to be surface-mounted on a printed circuit board (PCB) comprising an insulating housing on whose lateral parts are fixed two positioning dogs to be soldered to the PCB, contacts to be soldered to the PCB, characterized in that the connector comprises an elastic means for snap-fit holding of the housing to the PCB intended, when said connector is placed on the PCB for surface-mounting, to hold the contacts pressing on the PCB such that surface-soldering can be carried out while each of the contacts is in a position such that the contacts are contained in a plane of reference for the coflatness of the contacts.

2. Input/output connector according to claim 1, characterized in that the elastic means for holding consists of snap-fit lugs situated on the lateral parts of the insulating housing opposite the positioning dogs in such a way that the PCB is held clamped between said snap-fit lugs and said positioning dogs while the contacts are constrained on corresponding contact pads of the PCB.

3. Input/output connector according to claim 1, characterized in that the elastic means for holding consists of at least one snap-fit lug situated on a rear part of the insulating housing opposite the contacts in such a way that the PCB is held clamped between said snap-fit lug and the contacts while constrained on corresponding contact pads of the PCB.

4. Input/output connector according to claim 1, characterized in that the elastic means for holding consists of snap-fit lugs situated directly in line with and to the rear of the positioning dogs so that the PCB is held clamped between the snap-fit lugs and the contacts while constrained on corresponding contact pads of the PCB.

5. Input/output connector according to claim 4, characterized in that extreme parts of the snap-fit lugs intended to come into contact with the PCB possess a cutout and are inclined with respect to a plane orthogonal to the plane of the PCB.

6. Process for mounting the input/output connector according to claim 1, characterized in that, when the connector is jammed into the PCB, a bearing load exerted on the connector, in a placement phase during surface-mounting, is used to bring about the automatic snap-fitting of the connector to the PCB in the exact desired plane.

7. Input/output connector for portable communication device intended to be surface-mounted on a printed circuit board (PCB) comprising an insulating housing on whose lateral parts are fixed two positioning dogs to be soldered to the PCB, contacts to be soldered to the PCB, characterized in that the connector comprises an elastic means for snap-fit holding of the housing to the PCB intended, when the connector is placed on the PCB for surface-mounting, to hold the contacts pressing on the said PCB, wherein surface-soldering can be carried out while each of the contacts is in a position such that the contacts lie in a predetermined tolerance interval with respect to a plane of reference for coflatness of the contacts.

* * * * *